US009810056B2

(12) United States Patent
Batke et al.

(10) Patent No.: US 9,810,056 B2
(45) Date of Patent: Nov. 7, 2017

(54) ENVIRONMENT-BASED TELEMETRY SYSTEM

(71) Applicant: NABORS DRILLING TECHNOLOGIES USA, INC., Houston, TX (US)

(72) Inventors: Keith Batke, Spring, TX (US); Matthew White, Spring, TX (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 217 days.

(21) Appl. No.: 14/633,176

(22) Filed: Feb. 27, 2015

(65) Prior Publication Data

US 2015/0247400 A1 Sep. 3, 2015

Related U.S. Application Data

(60) Provisional application No. 61/946,470, filed on Feb. 28, 2014.

(51) Int. Cl.

| | |
|---|---|
| ***E21B 47/12*** | (2012.01) |
| ***E21B 47/18*** | (2012.01) |
| ***E21B 44/00*** | (2006.01) |
| ***E21B 47/06*** | (2012.01) |

(52) U.S. Cl.

CPC ..... *E21B 47/12* (2013.01); *E21B 44/00* (2013.01); *E21B 47/06* (2013.01); *E21B 47/122* (2013.01); *E21B 47/18* (2013.01); *E21B 47/187* (2013.01)

(58) Field of Classification Search

CPC ..... E21B 47/187; E21B 47/12; E21B 47/122; E21B 47/18

See application file for complete search history.

(56) References Cited

U.S. PATENT DOCUMENTS

| | | | | |
|---|---|---|---|---|
| 2002/0101242 | A1* | 8/2002 | Bittar | G01V 3/30 324/338 |
| 2007/0057811 | A1* | 3/2007 | Mehta | G01V 11/002 340/853.3 |
| 2009/0255661 | A1* | 10/2009 | Clark | E21B 41/0035 166/50 |
| 2010/0212963 | A1* | 8/2010 | Gopalan | E21B 47/187 175/40 |
| 2011/0198076 | A1* | 8/2011 | Villreal | E21B 21/08 166/250.01 |

(Continued)

*Primary Examiner* — Mohamed Barakat

(74) *Attorney, Agent, or Firm* — Enrique Abarca; Abel Law Group, LLP

(57) ABSTRACT

An MWD system with a BHA sensor assembly that can be assembled and tested off-site and then transported to the field and that requires fewer on-site workers to install and operate the system. The BHA sensor assembly can include a sensor for monitoring at least one physical parameter of the BHA and a processor for collecting the data from the sensor, analyzing the data to determine whether a physical condition has been met, and, if so, activating the telemetry system to begin transmitting drilling information to the surface. In some embodiments, a determination that a physical condition has been met can be used to activate or discontinue local logging of data to memory. Data from sensors can also be used to trigger a modification of the types and/or rates of data that are transmitted to the surface and/or logged to memory.

19 Claims, 4 Drawing Sheets

(56) References Cited

U.S. PATENT DOCUMENTS

| | | | | |
|---|---|---|---|---|
| 2012/0316787 | A1* | 12/2012 | Moran | E21B 44/00 702/9 |
| 2013/0146279 | A1* | 6/2013 | Chang | E21B 47/12 166/244.1 |

* cited by examiner

ENVIRONMENT-BASED TELEMETRY SYSTEM

CROSS-REFERENCE TO RELATED APPLICATION(S)

This application claims priority under 35 U.S.C. §119(e) to U.S. Patent Application No. 61/946,470 entitled "Environment-Based Telemetry System," by Keith Batke and Matthew White, filed Feb. 28, 2014, which is assigned to the current assignee hereof and incorporated herein by reference in its entirety.

FIELD OF THE DISCLOSURE

The present disclosure is directed to a measurement while drilling (MWD) tool. More specifically, but without limitation, this invention relates to an improved MWD apparatus that can control the transmission of data based upon changes in the tool environment.

BACKGROUND

Operators drill wells many thousands of feet in the search for hydrocarbons. The wells are expensive and take a significant amount of time to plan. To obtain hydrocarbons such as oil and gas, boreholes are drilled by rotating a drill bit attached to a drill string. The drill bit is typically mounted on the lower end of the drill string as part of a bottom-hole assembly (BHA) and is rotated by rotating the drill string at the surface and/or by actuation of down-hole motors or turbines.

Operators find it important to obtain data about the various subterranean reservoirs once the actual drilling begins. Thus, tools have been developed that gather information about the drilling equipment and or the down-hole conditions and transmit the data to the surface. A typical BHA will include a variety of sensors used to monitor various down-hole conditions—such as pressure, spatial orientation, temperature, or gamma ray count—that are encountered while drilling. A typical BHA will also include a telemetry system that processes signals from these sensors and transmits data to the surface. Engineers and geologist can then use this data in an effort to understand the formations and make plans on completion, sidetracking, abandoning, further drilling, etc.

The use of sensors during the drilling operation to provide information related to positioning or steering the drill, such as direction, orientation and drill bit information, is referred to as "Measurement While Drilling" (MWD). The phrase "Logging While Drilling" (LWD) is often used to using sensors for petrophysical or geological measurements during drilling. As used herein, "MWD" will also be used to encompass LWD applications unless otherwise specified.

An assembled BHA, which can include the drill bit, a steering assembly, a down-hole motor, a MWD/LWD sensor assembly, and a telemetry system, is typically around 100 to 150 feet in length. Also, it is not uncommon for a drilling operation to make use of modular components from different manufacturers in a single BHA. As a result, the BHA, including the sensors and telemetry system, is usually assembled at the well site. After assembly, the BHA components are typically tested to ensure they are operating correctly before the BHA is employed. Assembly and operation of the electrical components of the BHA is potentially hazardous at the well site because of the possibility of flammable gases. Testing procedures may also require heating up the system batteries to operating conditions (>130° C.) which has sometimes resulted in accidental battery explosions that have killed or injured workers at the well site. Further, there is a desire in modern drilling operations to automate as much of the drilling process as possible. Assembly and testing at the well site requires the presence of a number of workers at the site, which runs counter to the goal of automating the systems so that fewer onsite workers are required.

What is needed is an improved MWD system with a BHA that can be assembled and tested off-site and then transported to the field and that requires fewer on-site workers to install and operate the system.

BRIEF DESCRIPTION OF THE DRAWINGS

The present disclosure may be better understood, and its numerous features and advantages made apparent to those skilled in the art by referencing the accompanying drawings.

The accompanying drawings are not intended to be drawn to scale. In the drawings, each identical or nearly identical component that is illustrated in various figures is represented by a like numeral. For purposes of clarity, not every component may be labeled in every drawing.

DESCRIPTION OF THE DRAWINGS

Embodiments of the present invention are directed at an improved MWD system with a BHA that can be assembled and tested off-site and then transported to the field and that requires fewer on-site workers to install and operate the system. In particular embodiments the BHA can include a drill bit having a cutting face, a downhole telemetry system for communicating drilling information to the surface, a sensor configured for monitoring at least one physical parameter of the BHA, and a processor configured for executing the computer instructions, wherein the computer instructions are configured for collecting the data from the sensor, analyzing the data to determine whether a physical condition has been met, and, if so, activating the telemetry system to begin transmitting drilling information to the surface. In some embodiments, a determination that a physical condition has been met can be used to activate or discontinue local logging of data to memory. In some instances, data from one or more sensors configured for monitoring at least one physical parameter of the BHA can be used to trigger a modification of the types and/or rates of data that are transmitted to the surface and/or logged to memory.

Figure 1:
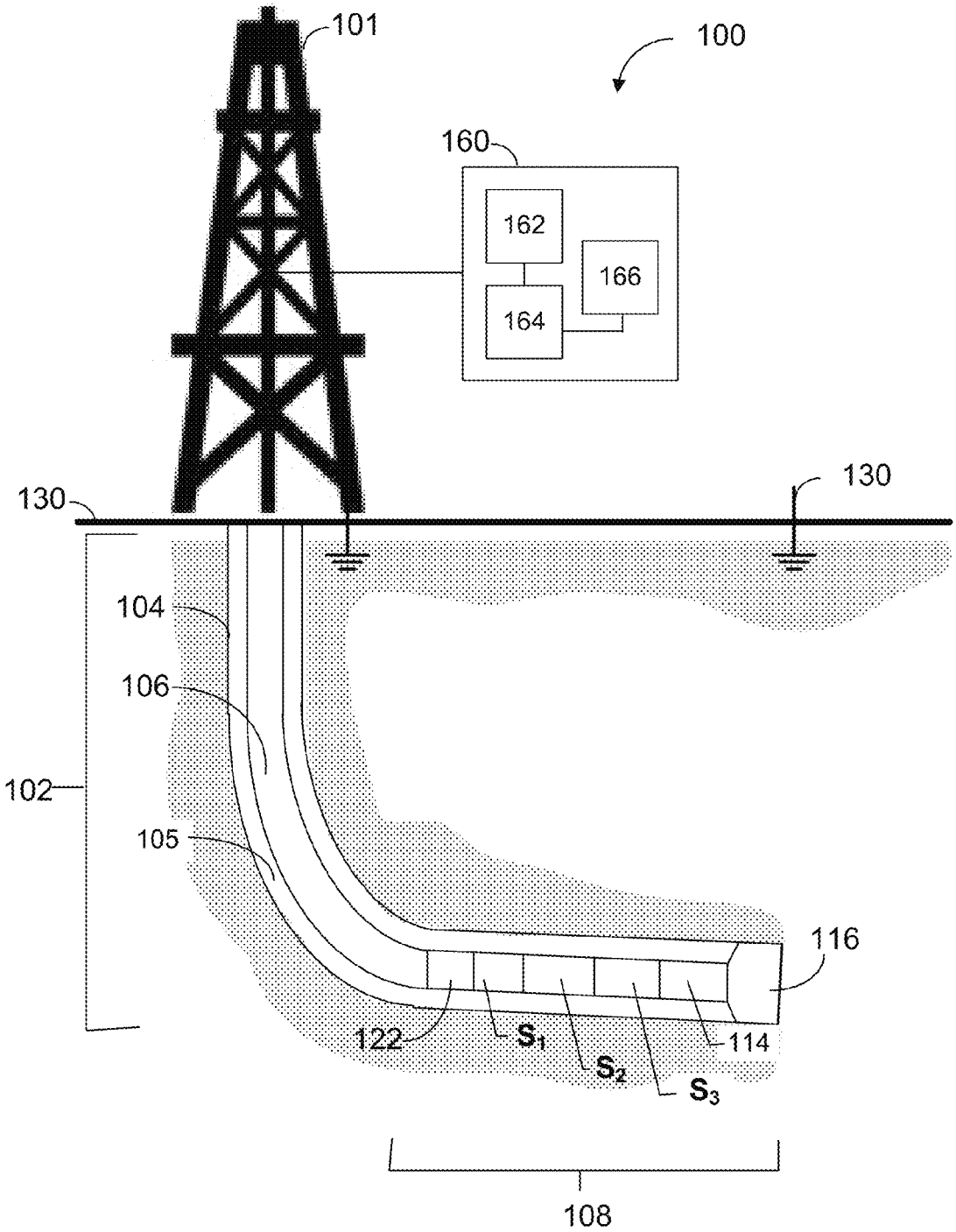
FIG. 1 is a schematic drawing of a prior art drilling system.

FIG. 1 is a simplified schematic illustration of a drilling system 100 that can be used in unconventional drilling operations such as horizontal drilling according to embodiments of the invention. A derrick 101 supports and rotates the drill string 102 in order to actually drill the well. The terms well, wellbore, and borehole are used herein as synonyms. The drill string 102, which is suspended within the borehole 104 once drilling is commenced, comprises a number of tubular sections connected together, with a drill bit 116 attached at the bottom of the drill string. The lowest part of the drill string, extending from the drill bit to the drill pipe, is referred to as the bottom-hole assembly ("BHA")

108. As used herein, terms such as "top," "up," "upper," "upwardly," or "upstream" will mean toward the surface of the well and terms such as "bottom," "down," "lower," "downwardly," or "downstream" will mean toward the terminal end of the well, regardless of the well-bore orientation.

A typical BHA can include the drill bit, a mud motor, a BHA sensor assembly (including MWD and LWD components), various connectors and subs, and a number of heavy weight drill collars (pipes) used to apply weight to the bit. The length of a conventional BHA assembly, including the number of heavy collars, can be from about 200 to about 400 feet.

A rotary table or a top drive (not shown) coupled to the drill string 102 may be utilized to rotate the drill string 102 at the surface to rotate the BHA 108 and thus the drill bit 116 to drill the borehole 104. A drilling motor 114 (also referred to as "mud motors") may also be provided to help rotate the drill bit. To operate the mud motor, a drilling fluid (often referred to as mud) from a source 170 is pumped under pressure into the drill pipe 106. The drilling fluid passes through flow bores throughout the length of the BHA and discharges at the bottom of the drill bit 116. The mud flow returns to the surface via the annular space 105 (also referred as the "annulus") between the drill string 102 and the inside wall of the borehole 104.

The BHA can also include one or more MWD and/or LWD sensors $S_1$, $S_2$, $S_3$ and related circuitry for measuring or determining one or more parameters relating to a formation being drilled. A telemetry system 122 can be used to process signals from the LWD and MWD sensors and transmit the data to the surface. The LWD and MWD sensors and/or other portions of the BHA may also have the ability to store measurements for later retrieval. Data transmission methods may include, for example, digitally encoding data and transmitting the encoded data to the surface, possibly as pressure pulses in the drilling fluid or mud system, acoustic transmission through the drill string, electronic transmission through a wireline or wired pipe, and/or transmission as electromagnetic (EM) pulses.

A control unit (or controller) 160, which may be a computer-based unit, may be placed at the surface 130 for receiving and processing data transmitted by the sensors in the drill bit and other sensors in the drilling assembly 130 and for controlling selected operations of the various devices and sensors in the BHA 108. The surface controller 160, in one embodiment, may include a processor 162, a data storage device (or a computer-readable medium) 164 for storing data and computer programs 166. Controller 160 can also include a monitor and input devices (such as a keyboard and mouse) so that controller 160 can also function as a human-machine interface for viewing data and inputting commands. Controller 160 may also pass received and/or processed data to other systems that perform a variety of known control and reporting functions. The data storage device 164 may be any suitable device, including, but not limited to, a read-only memory (ROM), a random-access memory (RAM), a flash memory, a magnetic tape, a hard disc and an optical disk.

Figure 2:
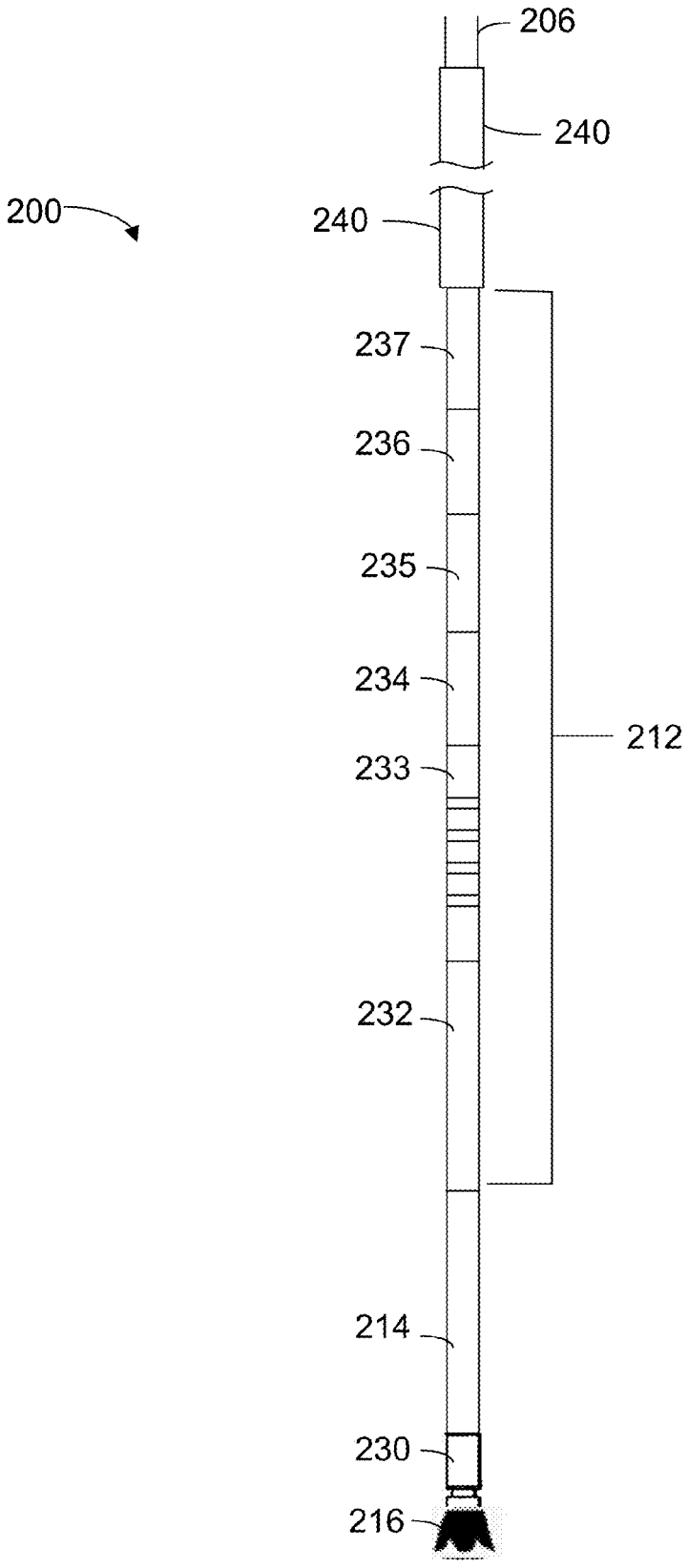
FIG. 2 is a schematic drawing of a prior art BHA.

FIG. 2 shows a schematic view of the lower portion of a bottom hole assembly (BHA) 200, which is attached to the drill pipe 206. BHA 200 includes a drill bit 216, a steerable assembly 230, a down hole motor 214, a sensor assembly 212, and several hundred feet of heavy drill collar sections 240. A typical BHA sensor assembly could include near bit and vibration sensors 232, a resistivity sensor 233, a directional sensor 234, a gamma ray sensor 235, a power supply 236, and a telemetry system such as a mud pulser 237. These and other components found in existing BHAs are typically arranged in a number of separate modules, which allows a driller to combine sensors/components from different manufacturers.

Particular embodiments of a MWD system preferably do not require wellsite assembly. A MWD system that is fully assembled and functional in the shop prior to shipment to the wellsite eliminates the need for field personnel to assemble the downhole tool. Assembly of the MWD at a factory or assembly center results in lower rates of damage to MWD components during assembly and allows for the use of more detailed functional verification procedures and increased management oversight. Assembly in a clean, controlled environment, rather than under harsh conditions in the field, also reduces the structural dynamic stresses on the printed circuit boards during assembly, which Applicants have discovered leads to significant improvement in reliability under the harsh shock and vibration environment of drilling operations.

Even where the BHA is assembled off-site, however, the system will still need to be powered up and the telemetry system activated before the BHA can be deployed. Obviously, it would be an undesirable waste of battery life to leave the system fully powered after assembly for the uncertain amount of time required to transport and deploy the system. However, powering up and activating the system manually at the wellsite still requires onsite personnel and equipment and typically results in higher rates of operator error during system configuration and increased opportunities for electrical and/or mechanical damage to system components. Further, it can sometimes be problematic to cold-start batteries and electronics so having the system at least partially powered during transport can be beneficial in this regard.

A BHA according particular embodiments includes one or more sensors for monitoring at least one physical parameter of the BHA. A physical parameter can include the orientation of the BHA (whether it is in a horizontal or vertical orientation), the environment surrounding the BHA (temperature, pressure, etc.), or the presence or absence of vibrations that indicate the drill bit is operating. The BHA can also include a processor configured to collect data from the one or more physical parameter sensors and to analyze the data to determine whether a physical condition has been met. The physical condition can be a predetermined condition providing an indication that the BHA has been deployed. In some embodiments, if the data indicates that the BHA has been deployed, the processor can fully power up the BHA and activate the various sensors and the telemetry system to begin transmitting drilling information to the surface. In some embodiments, a determination that a physical condition has been met can be used to activate or discontinue local logging of data to memory.

Figure 3:
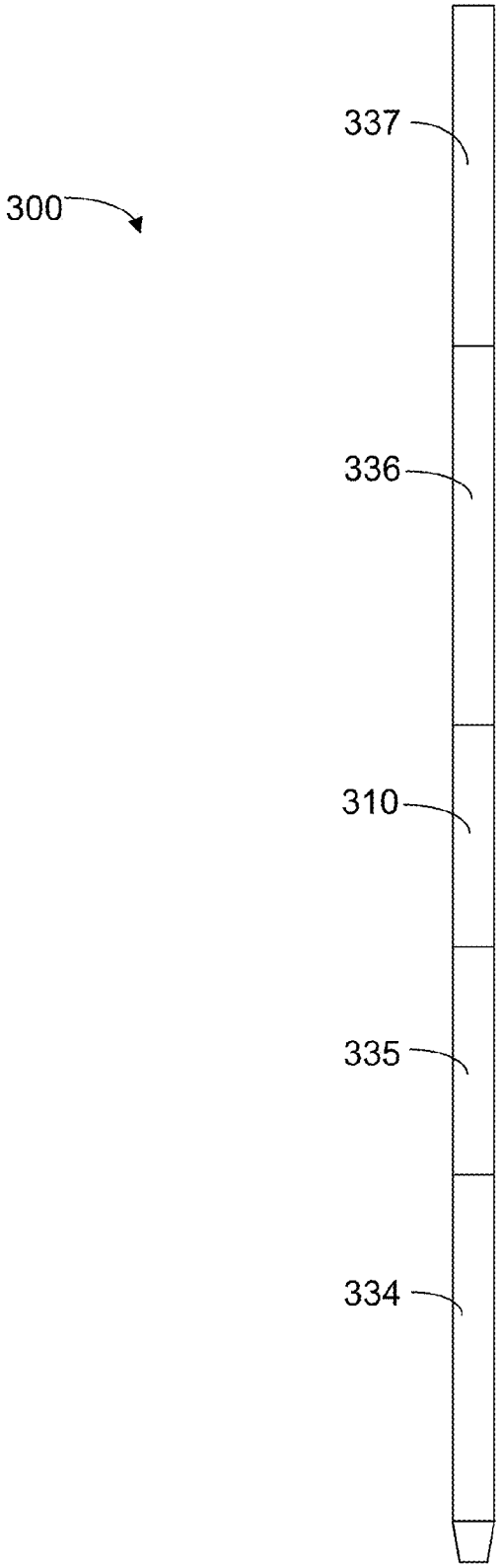
FIG. 3 is a schematic drawing of a portion of a BHA according to an embodiment.

FIG. 3 shows a schematic view of a portion of a BHA according to an embodiment of the invention described herein. Drill collar 300 houses a directional sensor 334, a gamma sensor 335, batteries 336, and a mud pulse system 337. Drill collar 300 also houses a circuit board 310 that includes on-chip sensors that can be used to monitor one or more physical parameters according to the invention described herein. In some embodiments, standard MWD or LWD sensors located anywhere in the BHA could be used to monitor the one or more physical parameters. Also, in some embodiments, one or more sensors on circuit board 310 could be used as MWD/LWD sensors in addition to monitoring one or more physical parameters as described herein.

In some embodiments, circuit board 310 can include a physical parameter sensor such as a 3-axis inclinometer and/or a 3-axis magnetometer that can be used to detect vibration and horizontal/vertical orientation. Because the BHA will be transported and stored in a largely horizontal position, an indication that the BHA has been moved to a substantially vertical orientation (for example, at least 70° from horizontal) likely means that the BHA has been deployed into a wellbore.

In some embodiments, the physical parameter sensors can include a temperature sensor and/or a pressure sensor. Because the temperature and pressure conditions in a wellbore are considerably different from the conditions that would be expected during transports and initial deployment, data obtained from such sensors can provide an indication that the BHA has been deployed. When the BHA temperature or pressure meets certain pre-determined minimums, the processor can cause the BHA to power-up and begin transmitting data. For example, in some embodiments, the temperature sensor can be a standard temperature sensor, such as a strip of a metal (e.g., platinum) with an electrical resistance that changes with temperature, that is mounted on a circuit board 310. Although such a temperature sensor would actually be measuring the temperature inside the drill collar, when the BHA assembly is subjected to the typical high temperatures inside the wellbore, the interior of the BHA assembly will soon heat up to a temperature that is substantially the same as the external temperature. In particular embodiments, the predetermined minimum temperature that triggers the sensor assembly power-up could be at least about 120° F., at least about 170° F., or least about 200° F. In some embodiments, a pressure sensor can be used to measure the annulus pressure and/or the interior pressure of the drilling fluid. The predetermined minimum pressure could be at least about 500 psi, at least about 1000 psi, or at least about 1500 psi.

A physical parameter sensor can also include one or more sensors for determining whether the drill string (and drill bit) is rotating. In some embodiments, a sensor can be use to directly determine rotation and rotational speed. In other embodiments, whether or not the drill string is rotating can be determined by using other sensors such as an accelerometer to measure vibration.

Particular embodiments can respond to a pre-defined change in a single physical parameter or to multiple physical parameters. For example, in some embodiments, the telemetry system will only be activated if sensor data indicates both that the BHA sensor assembly has been moved to a substantially vertical orientation and that the drill string is rotating. In other words, both conditions must be met in order for the telemetry system to be activated.

In other embodiments, three or more physical parameters may be monitored and the telemetry system activated only after pre-defined conditions are met by at least two of the monitored physical parameters. For example, in some embodiments, the system will monitor sensor assembly orientation, drill string rotation, and annulus fluid temperature. The telemetry system will only be activated if sensor data indicates that at least two of the following conditions are satisfied: (1) the BHA sensor assembly has been moved to a substantially vertical orientation; (2) the drill string is rotating; or (3) the fluid temperature surrounding the sensor assembly drill collar has reached a certain minimum temperature. This allows the system to be more robust in that a failure in one (or even more) of the sensor assemblies will not prevent the telemetry system from activating.

In some embodiments, after drilling is commenced and the telemetry system powers up and begins transmitting data, the system can continue to monitor drill string rotation. When there is an indication, either from a direct rotation sensor or sensors used to detect vibration, that drill string rotation has ceased, the telemetry system can stop transmitting and return to a low power condition to preserve battery life. When there is an indication that drill string rotation has re-commenced, the telemetry system can power back up and resume data transmission.

Embodiments of the invention described herein are not limited to activating or deactivating telemetry or logging. In some embodiments, the telemetry system can adjust the types of data or data rates being transmitted to the surface based upon a physical parameter such as drill string rotation. In a typical BHA telemetry system, there is extremely limited bandwidth in terms of data transmission to the surface. As a result, it is sometime desirable to change the type of data being transmitted or the data or sample rate for transmitted data. Typical BHA systems often require that the BHA be removed from the wellbore to change data transmission to surface or data rates. In particular embodiments, the system can change the data being transmitted or adjust the transfer and/or sample rate based upon one or more measured physical parameters. For example, when the sensors indicate that rotation has ceased, the system can stop transmitting some types of data such as data regarding rotational inclination or rotational azimuth. Other types of sensor data transmission (such as data indicating tool face orientation) can be commenced when the drill rotation stops, and shut down when rotation resumes. In some embodiments, the system can alter the transmission data from some certain sensors depending on whether there is an indication that the drill string is rotating. For example, in some embodiments, data from a gamma sensor can be transmitted more frequently or even continuously with the drill string is rotating, but can be transmitted less often when the drill string is not rotating.

Figure 4:
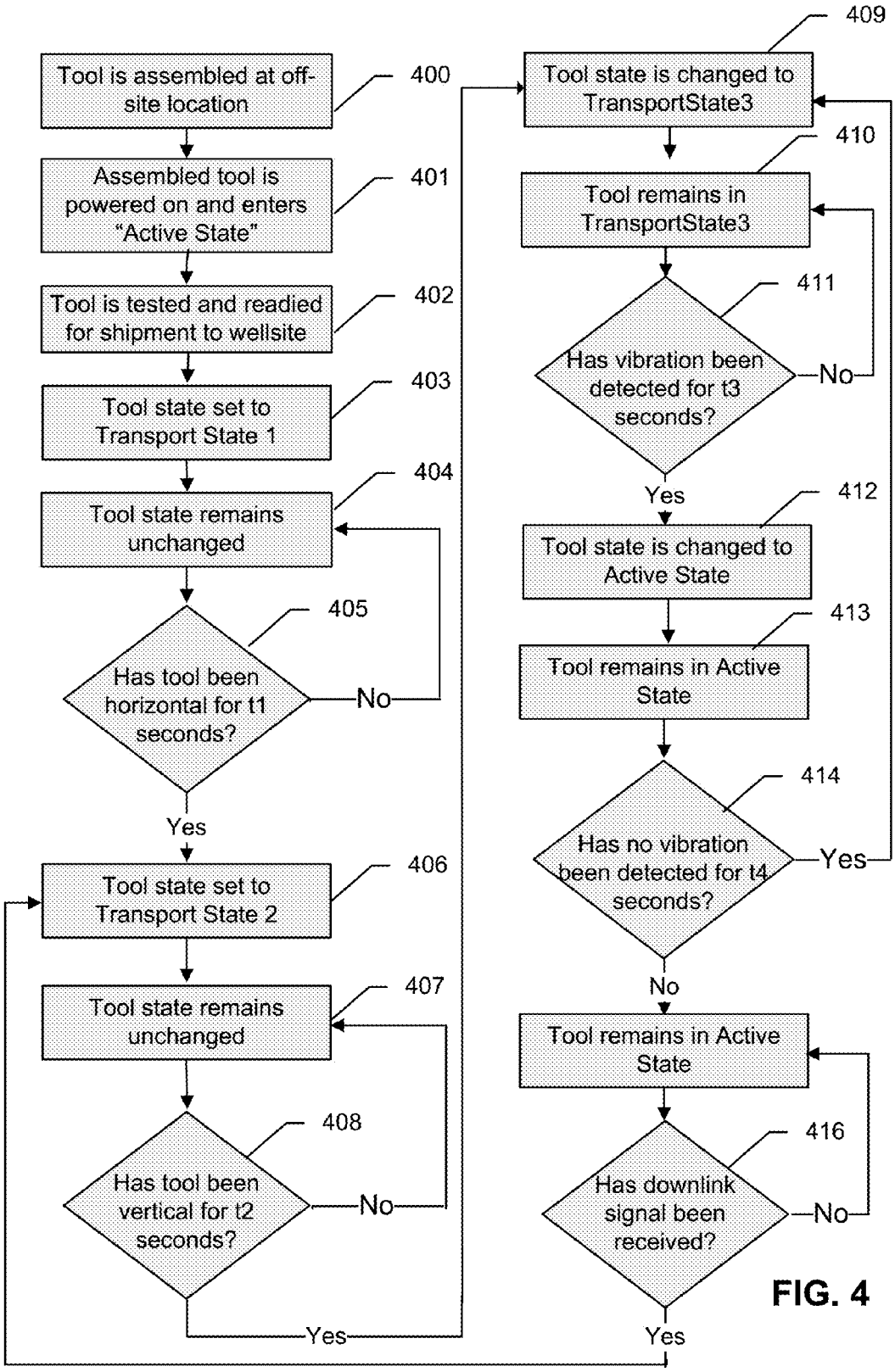
FIG. 4 is a flowchart describing a particular embodiment

FIG. 4 is a flowchart describing a particular embodiment. In step 400, at least a portion of a BHA sensor assembly (also referred to herein as the "tool") can be assembled at an off-site location such as a shop or manufacturing/assembly facility at a location separate from the wellsite. For example, in some embodiments, the portion of the drill collar containing physical parameter sections and the telemetry system can be assembled in the shop. In some embodiments, the assembled tool could be the portion of a bottom hole assembly (BHA) 200 as shown in FIG. 4.

Once the tool has been completely assembled, in step 401 it can be powered on and set to a state referred to herein as its "Active State," where the tool is fully powered up and functioning and the telemetry system is transmitting. In step 402, the tool is tested to insure that all components are functioning properly. In some embodiments, particular sensors can also be calibrated to ensure accurate measurements. Once testing/calibration is complete the tool is readied to ship to the wellsite. At this point, the tool can be switched to a transport configuration that can be referred to as "Transport State 1," in which the telemetry system and all or most of the MWD sensors are powered down. In some embodiments, data is also not being logged to on-board memory while the tool is in a transport configuration. The switch to Transport State 1 can be accomplished, for example, by way of a command from by an operator using a separate computer system to interface with and control the on-board tool computer system/processor.

In step 405, an orientation sensor such as an inclinometer is used to determine whether the BHA sensor assembly is in a substantially horizontal position for a specified time (t1), as discussed in greater detail below. If so, the tool state will be set to "Transport State 2." After initial assembly and testing, the BHA sensor assembly will typically already be in a horizontal orientation and will immediately switch to Transport State 2. In some embodiments, the tool can also be manually switched to Transport State 2, for example by an operator using a separate computer system to interface with and control the on-board tool computer system/processor.

In Transport State 2, the telemetry system and all or most of the MWD sensors are also powered down. In some embodiments, the sensors monitoring one or more physical parameters may also be MWD sensors, in which case those sensors are still powered up and functioning. By powering down all non-essential systems and components, battery life is preserved while the tool is transported to a wellsite. The tool is also safer to handle during transport and installation into the drill string.

In particular embodiments, the data from one or more physical property sensors, such as an inclinometer, is collected and recorded by a processor executing computer instructions. The received data is compared to pre-selected values to determine whether a condition is met. For example, the data from an inclinometer could be used to determine whether the BHA sensor assembly (or the portion of the assembly containing the inclination sensor) has been substantially parallel for the pre-selected time $t_1$. In some embodiments, the particular range of acceptable angles can be adjusted. For example, the sensor assembly can be considered to be substantially horizontal as long as the longitudinal axis of the assembly is less than about ±40 degrees from horizontal.

In particular embodiments, the tool will then remain in Transport State 2 (step 407) until a sensor configured for monitoring at least one physical parameter of the BHA sensor assembly determines that a specific physical parameter has been satisfied. In other embodiments, the tool will remain in Transport State 2 until a plurality of sensors configured for monitoring at least one physical parameter of the BHA sensor assembly determine that a plurality of specific physical parameters have been satisfied. In some embodiments, the specific physical parameters will need to be satisfied in a proper sequence for the tool state to change. In some embodiments, only some of the monitored conditions will need to be satisfied in order for the tool state to change.

In the example of FIG. 4, the inclinometer sensor can be used to determine whether the tool has been moved to a substantially vertical orientation for a specified time (t2) (step 408). If not, the tool remains in Transport State 2 (step 407); but if so, the tool state is changed to Transport State 3 (step 409). Again, the particular range of acceptable angles to be considered substantially vertical can be adjusted. For example, the sensor assembly can be considered to be substantially vertical as long as the longitudinal axis of the assembly is at least 60° from horizontal.

In Transport State 3, the telemetry system and sensors are powered down just as in the previously described transport configurations. In Transport State 3, however, one specified physical parameter (vertical orientation) has been satisfied. The system of FIG. 4, which requires that two separate physical parameters be satisfied, then begins to monitor a second physical parameter. In some embodiments, two or more physical parameters may be monitored simultaneously. In others, such as the embodiment of FIG. 4, two (or more) environmental change events are monitored in sequence. In embodiments requiring that a more than two physical parameters be satisfied in sequence, multiple transport states can be defined (Transport State 4, Transport State 5, etc.) with each indicating that the previous parameters have been satisfied.

In the embodiment of FIG. 4, once the tool has been placed into Transport State 3, at least one additional sensor is monitored to determine whether a second physical parameter has been satisfied. In this case, an accelerometer can be used to detect vibration. When vibration has been detected for a long enough time period (t3) this can be taken as an indication that the drill string is rotating and drilling has commenced. In step 411, it is determined whether vibration has been detected for time t3. If not, the tool will remain in Transport State 3 (step 413); and if so, the tool state is changed to Active State (step 414). Because the sensor data indicates that the tool is in a vertical orientation and that drilling has commenced, the tool state will be set to "Active State" and all components and the telemetry system can be activated. In some embodiments, setting the tool state to "Active State" can cause the system to activate local logging of data to memory. Such local data logging can be an alternative to or in addition to data transmission via a telemetry system.

In some embodiments, vibration can be continually monitored. Whenever no vibration (or insufficient vibration) has been detected over a pre-selected time (t4) this can be taken as an indication that drilling has stopped. In step 414, it is determined whether there has been a time of sufficient duration t4 with no vibration (which indicates no drilling is occurring). If data from the vibration sensor indicates that drilling has ceased for a sufficient length of time, the tool state will be reset to Transport State 3 (step 409), in which the telemetry system and some sensors are powered down. In Transport State 3, as described above, the system can be returned to Active State once vibration is detected for a sufficient time to indicate that drilling has been restarted (steps 411-412).

If in step 414, there has been no time of sufficient duration without vibration, then drilling is continuing and the tool will remain in Active State (415).

In some embodiments, a tool in any one of the possible tool states can be manually placed into any other tool state by downhole communication with the tool. For example, in some particular embodiments, the tool state could be changed from Active State to any of the transport configurations (or the reverse) by a downlink sequence which consists of cycling between vibration on and vibration off in a predefined timing sequence. In the embodiment of FIG. 4, if an appropriate downlink sequence is detected (step 416) the tool state will be changed to Transport State 1, typically in preparation for removing the tool from the wellbore.

In some embodiments, the tool can also monitor sensor data while in Active State and the tool state modified as desired based upon sensor data. For example, in some embodiments, the system can determine whether a tool in Active State (or Transport State 1) has been horizontal for a preselected amount of time. If so, this could be an indication that the tool has been removed from the wellbore and the tool can be re-set to Transport State 2 (in which the tool is waiting for a return to vertical orientation as described above). In other embodiments, two or more physical parameters, such as vibration and orientation, could be continually monitored in parallel, with a change in at least two physical attributes required to trigger a change in state from Active State to a transport configuration. For example, if the orientation and vibration sensors indicate that the tool has been horizontal for a specified time and that drilling has stopped for another specified time, this can be taken as an indication that the tool has been removed from the wellbore and the tool state will be re-set to a transport configuration, with some or all of the electronics components (other than those involved in monitoring the desired physical parameters) shut down to conserve battery life. As will be recognized by persons of skill in the art, any desired number of physical characteristics could be monitored and the tool state modified in any desired manner based upon changes in any number or in all of the monitored physical states. This might be particularly useful in horizontal drilling when it would be undesirable to have the tool change to a transport configuration based solely upon a horizontal orientation. In other instances, that particular feature would be disabled (or not present) and the tool state for a tool already placed into service would be controlled via a downlink sequence as described above.

At any point after a tool has been returned to a transport configuration, if sensor data indicates that the tool has been returned to the wellbore and drilling recommenced, for example by an indication that the tool has returned to a vertical orientation (step 408) and by the detection of vibration for t3 seconds (step 411), the tool will return to Active State.

Embodiments of the particular invention are especially advantageous in the context of drilling automation. The majority of the surface systems today require excessive hardware and personnel to operate. However, an automated drilling process would obviously be very desirable from a cost-saving perspective. An MWD system as described herein plays a pivotal role in drilling automation in that the data acquired from the MWD system is required to automate the overall drilling process. Therefore the goal of reducing/eliminating personnel from the wellsite during the drilling operation must be adhered to when designing an MWD system. Persons of skill in the art will recognize that embodiments of the present invention could also be advantageous in reducing battery consumption and memory use, even for systems that are assembled at the wellsite.

It is noted that the meaning of the word "measuring," in the context of the present disclosure, may include measuring, detecting, sensing, calculating, and/or otherwise obtaining data. Similarly, the meaning of the word "measure" in the context of the present disclosure may include detect, sense, measure, calculate, and/or otherwise obtain data. The measurements performed by the sensors described herein may be performed once, continuously, periodically, and/or at random intervals. The measurement may be manually triggered by an operator or other person accessing a human-machine interface (HMI), or automatically triggered by, for example, a triggering characteristic or parameter satisfying a predetermined condition (e.g., expiration of a time period, drilling progress reaching a predetermined depth, drill bit usage reaching a predetermined amount, etc.). Such sensors and/or other measurement means may include one or more interfaces which may be local at the well/rig site or located at another, remote location with a network link to the system.

In preferred embodiments, a single computer at the wellsite is used to gather all required data and to make that data available through a remote operating center. Single computer operation of the surface equipment reduces complexity and allows for much faster and simpler installation at the wellsite and in some cases may allow the MWD system to travel along with the rig equipment, eliminating the need for per well assembly and disassembly entirely.

In particular embodiments, the MWD system makes use of high-density NAND flash memory, low-power microcontrollers w/highly integrated peripherals, flexible communication protocols and high-efficiency DC/DC converters. This provides the inventive MWD system with components having lower power consumption and higher reliability operation over a wider temperature range, all in a very condensed footprint as compared to existing MWD systems. Preferred embodiments also make use of components that are rated and qualified to 175° C. to reduce failures at the typical operating temperatures of the MWD components.

The present invention has broad applicability and can provide many benefits as described and shown in the examples above. The embodiments will vary greatly depending upon the specific application, and not every embodiment will provide all of the benefits and meet all of the objectives that are achievable by the invention. Note that not all of the activities described above in the general description or the examples are required, that a portion of a specific activity may not be required, and that one or more further activities may be performed in addition to those described. Still further, the order in which activities are listed are not necessarily the order in which they are performed.

Embodiments of the present invention are described generally herein in relation to drilling directional wells or unconventional wells, but it should be understood, however, that the methods and the apparatuses described may be equally applicable to other drilling environments. Further, while the descriptions and figures herein show a land-based drilling rig, one or more aspects of the present disclosure are applicable or readily adaptable to any type of drilling rig, such as jack-up rigs, semisubmersibles, drill ships, coil tubing rigs, well service rigs adapted for drilling and/or re-entry operations, and casing drilling rigs, among others within the scope of the present disclosure.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention. After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present). Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Item 1. A bottom hole assembly (BHA) for use with a downhole measurement-while-drilling (MWD) system, the BHA comprising:

a drill bit having a cutting face;

a downhole telemetry system for communicating drilling information to the surface;

a sensor configured for monitoring at least one physical parameter of the BHA;

a processor configured for executing the computer instructions, wherein the computer instructions are configured for:

collecting the data from the sensor;

analyzing the data to determine whether a physical condition has been met; and if so, activating the telemetry system to begin transmitting drilling information to the surface.

Item 2. A BHA sensor assembly for use with a downhole MWD system, the sensor assembly comprising:

a downhole telemetry system for communicating drilling information to the surface;

a sensor configured for monitoring at least one physical parameter of the BHA;

a processor configured for executing the computer instructions, wherein the computer instructions are configured for:

collecting the data from the sensor;

analyzing the data to determine whether a physical condition has been met; and if so, activating the telemetry system to begin transmitting drilling information to the surface.

Item 3. Any one of the preceding items in which the downhole telemetry system comprises an electromagnetic pulse telemetry system.

Item 4. Any one of the preceding items in which the downhole telemetry system comprises a mud pulse telemetry system.

Item 5. A bottom hole assembly (BHA) for use with a downhole measurement-while-drilling (MWD) system, the BHA comprising:

a drill bit having a cutting face;

a logging while drilling (LWD) system including a memory for storing drilling data;

a sensor configured for monitoring at least one physical parameter of the BHA;

a processor configured for executing the computer instructions, wherein the computer instructions are configured for:

collecting the data from the sensor;

analyzing the data to determine whether a physical condition has been met; and if so, activating the LWD system to begin logging drilling data to the memory Item 6. The apparatus of any one of the preceding items in which the sensor configured for monitoring at least one physical parameter of the BHA comprises a temperature sensor.

Item 7. The apparatus of any one of the preceding items in which the sensor configured for monitoring at least one physical parameter of the BHA comprises a pressure sensor.

Item 8. The apparatus of any one of the preceding items in which the sensor configured for monitoring at least one physical parameter of the BHA comprises an orientation sensor.

Item 9. The apparatus of item 8 in which the orientation sensor comprises and 3-axis inclinometer and/or a 3-axis magnetometer.

Item 10. The apparatus of any one of the preceding items further comprising a vibrational sensor for determining when the BHA has stopped drilling and when the BHA recommences drilling.

Item 11. The apparatus of item 10 in which the processor is configured to analyze data from the vibrational sensor to determine whether drilling has stopped and, if so, to turn off the transmission of drilling information to the surface.

Item 12. The apparatus of item 10 in which the processor is configured to analyze data from the vibrational sensor to determine whether drilling has stopped and, if so, to turn off the transmission of some types of drilling information to the surface.

Item 13. The apparatus of item 11 in which the processor is configured to analyze data from the vibrational sensor to determine whether drilling has recommenced and, if so, to turn on the transmission of drilling information to the surface.

Item 14. A method of using a bottom hole assembly (BHA) with a downhole measurement-while-drilling (MWD) system, the method comprising:

providing a BHA including:

a drill bit having a cutting face;

a downhole telemetry system for communicating drilling information to the surface;

a sensor configured for monitoring at least one physical parameter of the BHA;

a processor configured for executing the computer instructions, wherein the computer instructions are configured for collecting the data from the sensor and analyzing the data to determine whether a physical condition has been met;

assembling the BHA at a remote location;

powering up and testing the assembled BHA at a remote location;

switching the BHA into a transport mode where the BHA is powered on but the downhole telemetry system is not transmitting;

transporting the assembled BHA to a drill site;

connecting the BHA to a drill string and using it to begin drilling a wellbore;

wherein the at least one physical parameter of the BHA monitored by the sensor provides an indication that the BHA is being used at the drill site and wherein the processor, upon a determination that the BHA is in use at the drill site, causes the downhole telemetry system to begin transmitting.

Item 15. Any one of the preceding items in which monitoring the at least one physical parameter of the BHA comprises monitoring the vertical/horizontal orientation of the BHA.

Item 16. Any one of the preceding items in which monitoring the at least one physical parameter of the BHA comprises monitoring the BHA temperature.

Item 17. Any one of the preceding items in which monitoring the at least one physical parameter of the BHA comprises monitoring the pressure surrounding the BHA.

Item 18. Any one of the preceding items in which monitoring the at least one physical parameter of the BHA comprises monitoring whether or not the BHA is rotating.

Item 19. Any one of the preceding items in which analyzing the data to determine whether a physical condition has been met comprises determining whether the BHA is in a horizontal position.

Item 20. Any one of the preceding items in which analyzing the data to determine whether a physical condition has been met comprises determining whether the BHA temperature has reached a predetermined minimum temperature.

Item 21. Item 20 in which the predetermined minimum temperature is at least about 120° C., at least about 170° C., or least about 200° C.

Item 22. Any one of the preceding items in which analyzing the data to determine whether a physical condition has been met comprises determining whether the pressure surrounding the BHA has reached a predetermined minimum pressure.

Item 23. Item 22 in which the predetermined minimum pressure is at least about 500 psi, at least about 1000 psi, or at least about 1500 psi.

Item 24. Any one of the preceding items further comprising at least one additional sensor configured for monitoring at least one additional physical parameter of the BHA.

Item 25. Item 24 in which analyzing the data to determine whether a physical condition has been met comprises analyzing the data from at least two different sensors to determine whether two different physical conditions have been met.

Item 26. Item 24 in which analyzing the data to determine whether a physical condition has been met comprises analyzing the data from at least three different sensors to determine whether at least two different physical conditions have been met.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

Although the present invention and its advantages have been described in detail, it should be understood that various changes, substitutions and alterations can be made to the embodiments described herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

We claim as follows:

1. A telemetry system for use with a bottom hole assembly (BHA) of a downhole drilling system, comprising:

a processor configured to activate the telemetry system to transmit drilling information upon a determination by the processor that the BHA has changed from a horizontal position to a vertical position.

2. The telemetry system of claim 1, wherein the telemetry system comprises an electromagnetic pulse telemetry system or a mud pulse telemetry system.

3. The telemetry system of claim 1, further comprising a temperature sensor, a pressure sensor, a vibrational sensor and/or an orientation sensor.

4. The telemetry system of claim 1, further comprising a 3-axis inclinometer and/or a 3-axis magnetometer.

5. The telemetry system of claim 1, wherein the processor is configured to determine when the BHA has stopped drilling and when the BHA recommences drilling.

6. The telemetry system of claim 1, wherein the processor is configured to determine whether drilling has stopped and, if so, to stop transmitting drilling information.

7. The telemetry system of claim 1, wherein the processor is configured to determine whether drilling has recommenced and, if so, to activate the telemetry system to transmit drilling information.

8. The telemetry system of claim 1, wherein the processor is configured to determine whether a BHA temperature has reached a predetermined minimum temperature.

9. The telemetry system of claim 1, wherein the processor is configured to determine whether a pressure surrounding the BHA has reached a predetermined minimum pressure.

10. The telemetry system of claim 1, wherein the processor is configured to analyze data from at least two different sensors to determine whether to activate the telemetry system to transmit drilling information.

11. The telemetry system of claim 1 further comprising a logging while drilling (LWD) system including a memory for storing drilling data.

12. A telemetry system for use with a bottom hole assembly (BHA) of a downhole drilling system, comprising:

a logging while drilling (LWD) system including a memory for storing drilling data; and a processor configured to activate the LWD system to store drilling data to the memory upon a determination by the processor that the BHA has changed from a horizontal position to a vertical position.

13. A method of using a bottom hole assembly (BHA) with a downhole measurement-while-drilling (MWD) system, the method comprising:

providing a BHA including:

a drill bit having a cutting face;

a downhole telemetry system for communicating drilling information to the surface;

a sensor configured for monitoring at least one physical parameter of the BHA;

a processor configured for executing the computer instructions, wherein the computer instructions are configured for collecting the data from the sensor and analyzing the data to determine whether a physical condition has been met;

assembling the BHA at a remote location;

powering up and testing the assembled BHA at a remote location;

switching the BHA into a transport mode where the BHA is powered on but the downhole telemetry system is not transmitting;

transporting the assembled BHA to a drill site while the BHA is in the transport mode;

connecting the BHA to a drill string and using it to begin drilling a wellbore;

wherein the at least one physical parameter of the BHA monitored by the sensor provides an indication that the BHA is being used at the drill site and wherein the processor, upon a determination that the BHA is in use at the drill site, causes the downhole telemetry system to begin transmitting.

14. The method of claim 13 in which the sensor configured for monitoring at least one physical parameter of the BHA comprises a temperature sensor, a pressure sensor, and/or an orientation sensor.

15. The method of claim 13 in which the sensor configured for monitoring at least one physical parameter of the BHA comprises an orientation sensor and in which analyzing the data to determine whether a physical condition has been met comprises determining whether the BHA is in a horizontal position.

16. The method of claim 13 in which the sensor configured for monitoring at least one physical parameter of the BHA comprises a temperature sensor and in which analyzing the data to determine whether a physical condition has been met comprises determining whether the BHA temperature has reached a predetermined minimum temperature.

17. The method of claim 13 in which the sensor configured for monitoring at least one physical parameter of the BHA comprises a pressure sensor and in which analyzing the data to determine whether a physical condition has been met comprises determining whether the pressure surrounding the BHA has reached a predetermined minimum pressure.

18. The method of claim 14 further comprising a vibrational sensor and in which the processor is configured to analyze data from the vibrational sensor to determine whether drilling has stopped and, if so, to cause the downhole telemetry system to stop transmitting.

19. The method of claim 18 in which the processor is configured to analyze data from the vibrational sensor to determine whether drilling has recommenced and, if so, to cause the downhole telemetry system to begin transmitting.

* * * * *